US006074530A

United States Patent [19]

Tillirson

[11] Patent Number: 6,074,530

[45] Date of Patent: Jun. 13, 2000

[54] METHOD FOR ENHANCING THE ANTI-SKID OR FRICTION PROPERTIES OF A CELLULOSIC FIBER

[75] Inventor: Eric Tillirson, Marietta, Ga.

[73] Assignee: Vinings Industries, Inc., Atlanta, Ga.

[21] Appl. No.: 09/010,427

[22] Filed: Jan. 21, 1998

[51] Int. Cl.[7] ..... D21H 17/68; D21H 17/66

[52] U.S. Cl. ..... 162/181.6; 162/181.8; 162/183; 162/158; 162/181.1; 162/181.2; 162/181.3

[58] Field of Search ..... 162/181.4, 181.1, 162/181.5, 181.6, 181.8, 183, 158, 163, 181.7, 175; 106/36; 427/395, 391

[56] References Cited

U.S. PATENT DOCUMENTS

| | | | |
|---|---|---|---|
| 2,643,048 | 6/1953 | Wilson . | |
| 2,872,094 | 2/1959 | Leptien . | |
| 3,547,663 | 12/1970 | Lawrence . | |
| 3,649,348 | 3/1972 | Vossos . | |
| 3,754,984 | 8/1973 | Payne . | |
| 3,860,431 | 1/1975 | Payne et al. . | |
| 3,901,987 | 8/1975 | Payne et al. . | |
| 3,916,058 | 10/1975 | Vossos . | |
| 4,385,961 | 5/1983 | Svending et al. | 162/175 |
| 4,418,111 | 11/1983 | Carstens . | |
| 4,452,723 | 6/1984 | Carstens . | |
| 4,643,801 | 2/1987 | Johnson | 162/164.1 |
| 4,952,279 | 8/1990 | Ikeda et al. . | |
| 4,954,220 | 9/1990 | Rushmere | 162/168.3 |
| 4,980,024 | 12/1990 | Payne et al. | 162/135 |
| 5,225,041 | 7/1993 | Richard et al. | 162/80 |
| 5,374,335 | 12/1994 | Lindgren et al. | 162/158 |
| 5,466,493 | 11/1995 | Mefford et al. . | |
| 5,501,771 | 3/1996 | Bourson . | |
| 5,569,318 | 10/1996 | Jarand . | |
| 5,584,966 | 12/1996 | Moffett | 162/168.1 |
| 5,591,307 | 1/1997 | Storeck . | |
| 5,603,805 | 2/1997 | Andersson et al. | 162/183 |
| 5,603,997 | 2/1997 | Lindgren et al. | 428/34.2 |
| 5,634,414 | 6/1997 | Johsnsson et al. | 162/164.6 |

FOREIGN PATENT DOCUMENTS

| | | |
|---|---|---|
| 0 277 633 A2 | 8/1988 | European Pat. Off. . |
| 0 522 940 A1 | 1/1993 | European Pat. Off. . |
| 5-86587 | 4/1993 | Japan . |
| 07025132 | 1/1995 | Japan . |
| WO 89/06637 | 7/1989 | WIPO . |

OTHER PUBLICATIONS

G.A. Smook, "Handbook for pulp and paper technologists," Angus Wide Publications, Vancouver, 2nd edition, Chapter 23, pp–228–229, Jan. 1992.

C.J. Biermann, "Essentials of Pulping and Papermaking," Academic Press, Inc. California, Chapter 8, pp 190–191, Jan. 1993.

Urals Forestry Inst. Apr. 30, 1987 SU–954649 (abstract).

Haller, Thomas M., "The Importance of Coefficients of Friction to the Newsprint Industry", 1989 Newsprint Conference, Quebec, pp 141–145.

Daul, Mike, The Influence of Deinked Fiber to Winding of Newsprint Rolls, 1992 Finishing and Converting Conference, pp. 53–61 (1992).

*Primary Examiner*—Stanley S. Silverman
*Assistant Examiner*—Jose' S. Fortuna
*Attorney, Agent, or Firm*—Needle & Rosenberg, P.C.

[57] ABSTRACT

The invention relates to a method for enhancing the anti-skid or friction properties of a cellulosic fiber, by transporting cellulosic fiber from a machine chest and then to a stuff box and then to a headbox; and contacting a suspension of the cellulosic fiber with an anionic colloidal silica prior to or at the stuff box. The invention further relates to a method for enhancing the anti-skid or friction properties of a cellulosic fiber, by transporting cellulosic fiber from a stuff box to a headbox; and contacting a suspension of the cellulosic fiber with an anionic colloidal silica prior to or at the stuff box. The invention further relates to the products produced by the present invention.

35 Claims, 3 Drawing Sheets

METHOD FOR ENHANCING THE ANTI-SKID OR FRICTION PROPERTIES OF A CELLULOSIC FIBER

FIELD OF THE INVENTION

The present invention relates to a method for enhancing the anti-skid or friction properties of a cellulosic fiber.

BACKGROUND OF THE INVENTION

Certain compounds present in wood have a deleterious effect on sheet coefficient of friction. Resinous and fatty acids such as oleic, linoleic, linolenic, palmitic and/or stearic acid are liberated from wood species during the pulping process. Due to their relatively low surface energies, these materials reduce the sheet coefficient of friction. Although pulp processing and washing reduce the total amount of these compounds significantly, carry over into the papermaking process is inevitable. The presence of these compounds in the finished sheet has been determined to significantly reduce the coefficient of friction of the sheet. Furthermore, by increasing the amount of deinked pulp in newsprint fiber, a significant increase in the amount of fatty acids is present in the stock slurry because fatty acid surfactants are used in the deinking process.

The need for enhanced coefficient of friction properties of printing papers, such as newspaper, is based on handling requirements of the paper reels in the paper mill as well as functional performance of the substrate in the converting process to a newspaper for use in the general public. Low kinetic coefficient of friction papers in the mill experience reel telescoping issues, which makes it difficult to transport finished rolls of paper in the mill. Another issue is crepe wrinkles, where the sheet will slip upon itself after having been wound into a tight reel. As the sheet slips, ridges or wrinkles form in the paper web. Once wrinkled, the paper web is unsuitable for printing and converting into the end product. A low coefficient of friction sheet also exhibits slipperiness in the converting process by misregistering on the printing papers press and running ahead during printing papers press stops or slow downs. The run ahead in the pressroom can result in damage to the print plates as well as break out on the printing papers press.

Prior art methods have attempted to increase the coefficient of friction of printing papers. One approach involves the addition of additives such as talc, hydrous kaolin, calcined kaolin or precipitated silica to paper in order to increase the coefficient of friction. Talc and hydrous kaolin tend to reduce friction due to their platelet morphology. One problem associated with the use of these materials includes abrasion and wear on paper production equipment due to abrasiveness of these additives. Another disadvantage is the relatively high dosage requirements (1 to 4% of furnish) of the additive, which translates to higher costs of manufacture. Finally, increased process costs associated with the need for retention aids as well as the adverse effects created by the use of dispersing agents in these materials adds further costs of using these additives as friction enhancers. Synthetic precipitated silicas also require high usage rates to impact friction; however, they do not tend to have a deleterious effect on friction at higher loadings as does kaolin and talc.

Colloidal silica has been used for many years in the art to increase the coefficient of friction of paper and paperboard. The majority of the prior art discloses the coating of the surface of a paper sheet with colloidal silica to enhance sheet friction. U.S. Pat. No. 2,872,094 to Leptien; U.S. Pat. Nos. 4,452,723 and 4,418,111 to Carstens; U.S. Pat. No. 3,916, 058 to Vossos; U.S. Pat. Nos. 3,901,987; 3,754,984 and 3,860,431 to Payne et al.; U.S. Pat. No. 5,466,493 to Mefford et al.; U.S. Pat. No. 5,569,318 to Jarrand; and Japanese Patent Application No. 05172989 to Yoshihiko et al. disclose the coating of a paper product with silica in order to enhance anti-skid properties.

Surface application is problematic in printing papers, especially in newsprint and light weight coated grades for several reasons. Paper produced with large proportions of mechanical fiber are generally produced on high speed paper machine and are low in strength and are difficult to size, which promotes some water resistance for improved printability. Size press or water box additions of colloidal silica are difficult because the low strength greatly increase the probability of sheet breaks. Although spraying the colloidal silica on the surface of the sheet is effective in the production of boxboard grade, the coating is not uniform and roughens the surface of the sheet, which makes the paper much less desirable for printing. In addition, colloidal silica sprayed on the sheet is accomplished after drying because the friction gain from the silica is diminished by skuffing action of paper passing over rollers in the process.

Another approach is to add the colloidal silica to paper pulp prior to converting to a paper product. U.S. Pat. No. 3,649,348 to Vossos; U.S. Pat. No. 2,643,048 to Wilson; and International Patent Application No. WO 89/06637 to Rushmere discloses the addition of silica to paper pulp; however, these references do not disclose adding silica to pulp at the point of addition in the invention herein.

U.S. Pat. No. 4,952,279 to Ikeda et al. discloses the addition of anionic silica to paper pulp. Ikeda et aL. does not explicitly recite where in the papermaking process the anionic silica is added to the paper pulp; however, it can be inferred from Ikeda et al. that the anionic silica is added at the headbox based on the concentration of the pulp in Example 3. U.S. Pat. No. 5,501,771 to Bourson discloses the addition of a retention system to paper pulp in the headbox. The retention system is composed of a cationic starch, a polyaluminum chloride, and anionic silica. One disadvantage of the prior art methods of Ikeda et al. and Bourson is that the concentration of the pulp is low, which means a higher concentration of anionic silica is necessary to impart anti-skid properties.

In light of the above it would be very desirable to have a method for enhancing the anti-skid properties of paper by using a low amount of colloidal silica. Such a method would be especially useful in the production of printing papers such as newspapers and light weight printing papers where surface treatment is either not feasible or not practical. During the production of newspapers and light weight printing papers, the newspapers and light weight printing papers are rapidly transported through the paper machine. Thus, treating the newspaper or light weight printing papers with an additive by coating or spraying techniques is not an efficient way to treat the newspaper or light weight printing papers with the additive. The present invention solves such a need in the art while providing surprising advantages.

SUMMARY OF THE INVENTION

In accordance with the purpose(s) of this invention, as embodied and broadly described herein, this invention, in one aspect, relates to a method for enhancing the anti-skid or friction properties of a cellulosic fiber, comprising:

a) transporting cellulosic fiber from a machine chest and then to a stuff box and then to a headbox; and b) contacting a suspension of the cellulosic fiber with an anionic colloidal silica prior to or at the stuff box.

The invention further relates to a method for enhancing the anti-skid or friction properties of a cellulosic fiber, comprising:

a) transporting cellulosic fiber from a stuff box to a headbox; and b) contacting a suspension of the cellulosic fiber with an anionic colloidal silica prior to or at the stuff box.

The invention further relates to the products produced by the present invention.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

Figure 1:
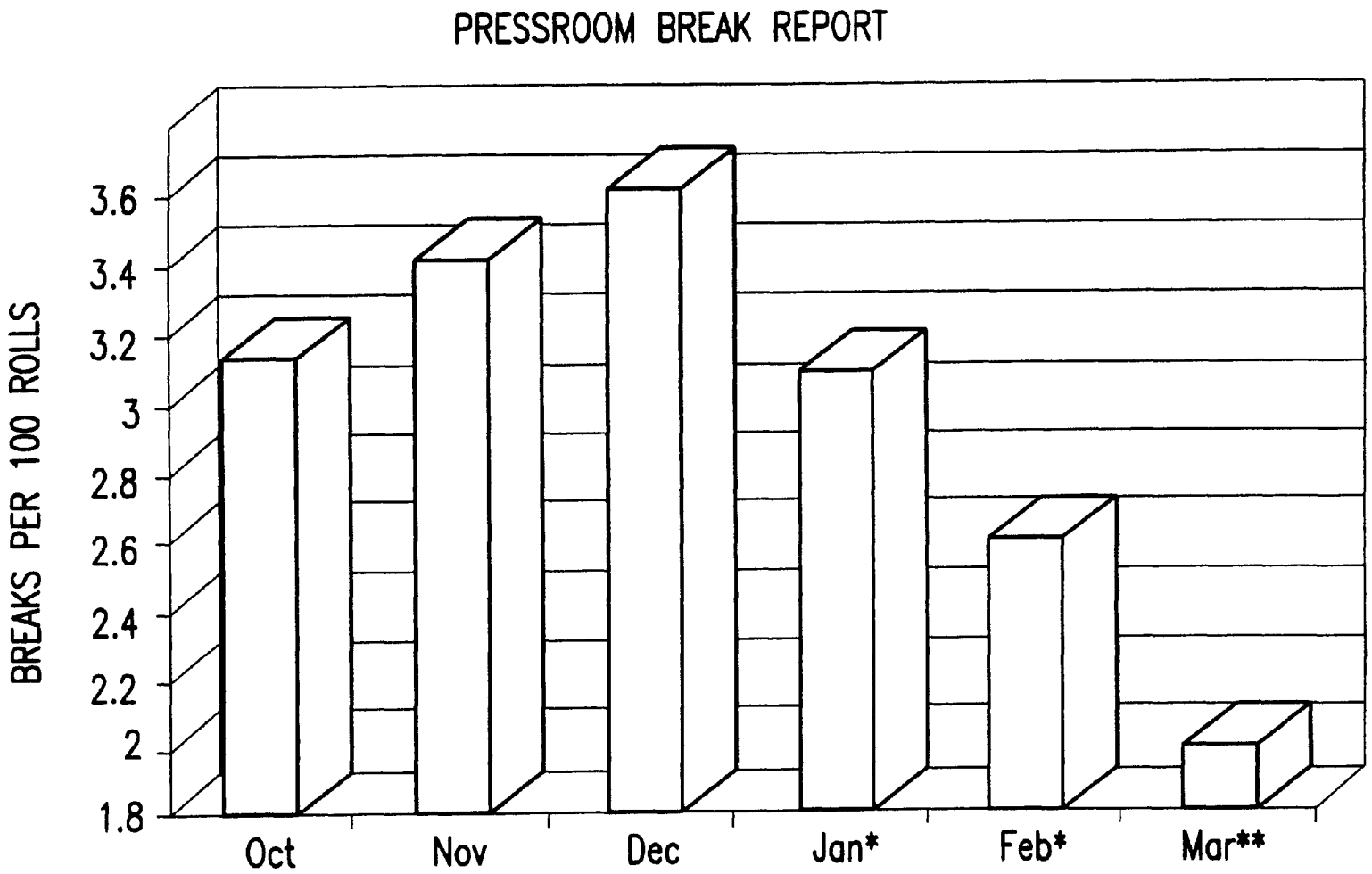
FIG. 1 demonstrates the reduction in breaks per 100 rolls that occurred in the particular press room when anionic colloidal silica sol was used in the paper manufacturing process.

The present invention may be understood more readily by reference to the following detailed description of preferred embodiments of the invention and the Examples included therein.

Before the present methods and products are disclosed and described, it is to be understood that this invention is not limited to specific synthetic methods or to particular formulations, as such may, of course, vary. It is also to be understood that the terminology used herein is for the purpose of describing particular embodiments only and is not intended to be limiting.

In this specification and in the claims which follow, reference will be made to a number of terms which shall be defined to have the following meanings:

The singular forms "a," "an" and "the" include plural referents unless the context clearly dictates otherwise.

"Optional" or "optionally" means that the subsequently described event or circumstance may or may not occur, and that the description includes instances where said event or circumstance occurs and instances where it does not.

The term "enhance" is defined as an increase in a desired effect and/or an increase in the duration of the desired effect or having the same or better effect with a lower amount of a silica additive.

The term "suspension" is defined as a substantially non-soluble mixture of a cellulosic fiber, water and other additives.

In accordance with the purpose(s) of this invention, as embodied and broadly described herein, this invention, in one aspect, relates to a method for enhancing the anti-skid or friction properties of a cellulosic fiber, comprising:

a) transporting cellulosic fiber from a machine chest and then to a stuff box and then to a headbox; and b) contacting a suspension of the cellulosic fiber with an anionic colloidal silica prior to or at the stuff box.

The invention further relates to a method for enhancing the anti-skid or friction properties of a cellulosic fiber, comprising:

a) transporting cellulosic fiber from a stuff box to a headbox; and b) contacting a suspension of the cellulosic fiber with an anionic colloidal silica prior to or at the stuff box.

The invention further relates to the products produced by the present invention.

The applicants have unexpectedly discovered that the point of addition of the colloidal anionic silica to a suspension of a cellulosic fiber is important with respect to enhancing the anti-skid properties of a cellulosic fiber. In one embodiment, the suspension is contacted with the anionic colloidal silica any point before the stuff box or at the stuff box. In another embodiment, the suspension is contacted with the anionic colloidal silica from between the machine chest and the stuff box. In another embodiment, the suspension is contacted with the anionic colloidal silica in the machine chest.

In another embodiment, the cellulosic fiber is transported to a blend chest prior to being transported to the machine chest. In one embodiment, the suspension is contacted with the anionic colloidal silica from between the blend chest and the machine chest. In another embodiment, the suspension is contacted with the anionic colloidal silica in the blend chest. In another embodiment, the suspension is contacted with the anionic colloidal silica prior to the blend chest. In a preferred embodiment, the anionic colloidal silica is added to the suspension in the blend chest or machine chest.

Figure 3:
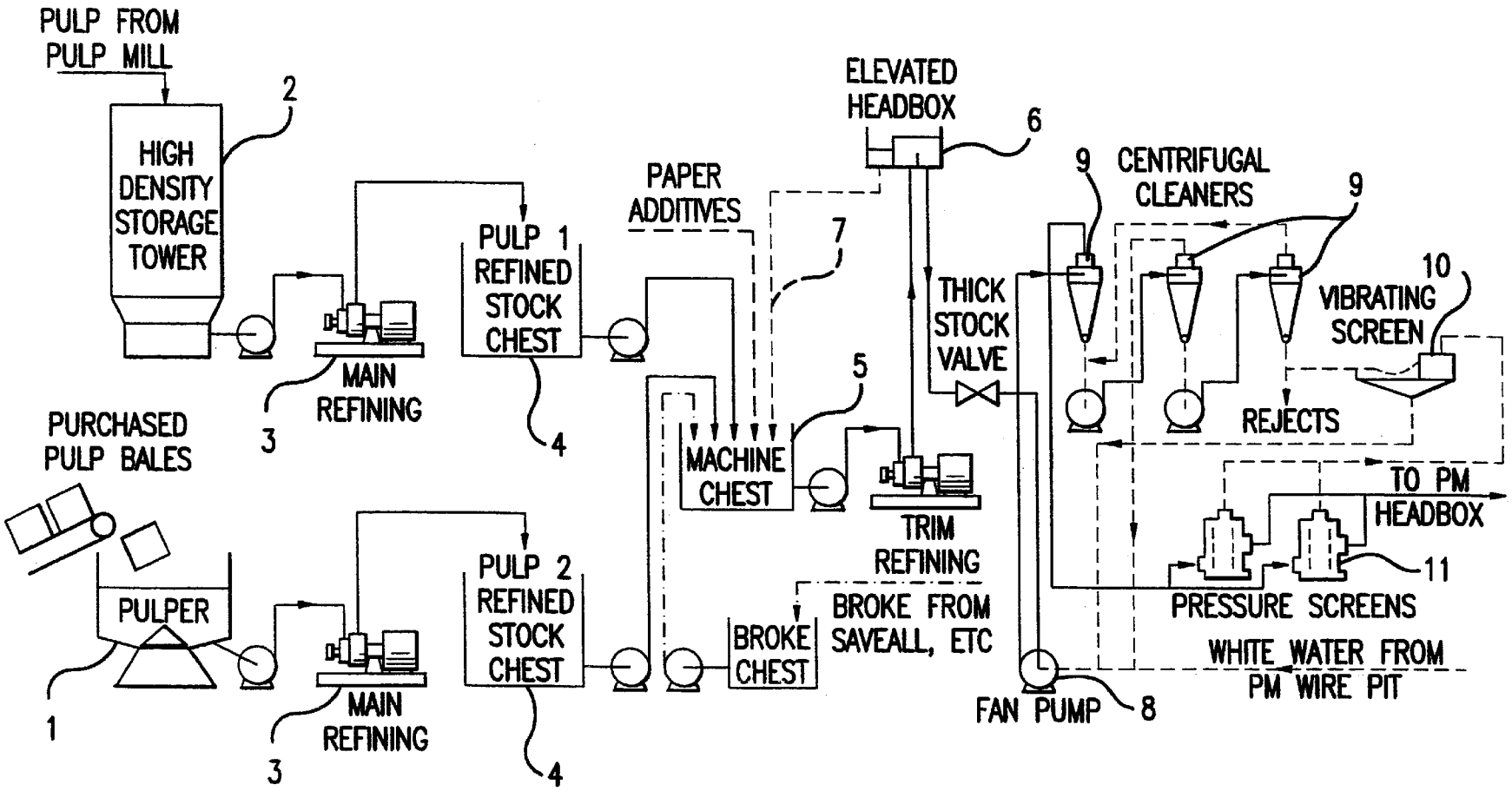
FIG. 3 is a schematic drawing of a typical paper making process used in the prior art as shown in the computer software program entitled *Paper Help* by Roger Grant (copyright 1994/1997, U.K.).

The present invention can be used with any paper making process, preferably a machine that produces newspaper. The components of a papermaking machine are well known and are disclosed in *Paper and Paperboard* by James E. Kline (copyright 1982 by James Kline), Chs. 4–6 (pages 38–126). A schematic drawing of a typical papermaking process used in the prior art is shown in FIG. 3. Such a process is used for the invention herein with respect to the basic unit operation steps and order of the steps.

The first step of the papermaking process involves generating the pulp. The pulping process, as shown in FIG. 3, involves adding a raw material (i.e. a wood or paper product) to the pulper (1) in order to remove the cellulosic fibers from the raw material. At this point, the pulp typically has a consistency of at least 12%. The term "consistency" is defined as the weight of pulp to weight of pulp plus water in the suspension, expressed as percent, wherein the weight % of the pulp and the water is equal to 100%. A high consistency means a high ratio of pulp to water.

Once the pulp has been generated from the raw materials, it can be stored in a storage tank or tower (2) prior to being refined or it can be refined immediately after the pulp has been generated. Examples of pulp useful in the present invention include, but are not limited to, bleached pulp, mechanical pulp, chemical pulp, de-inked pulp, or recycled paper pulp. The pulp is refined (labeled "main refining" in FIG. 3 (3)) with the aid of consistency regulators. Consistency regulators measure the viscosity or resistance of the stock to flow. The refiner can vary depending upon the type of pulp selected. The refiner softens and fibrillates the cellulosic fiber, which ultimately increases the surface area of the fiber.

After refining, the pulp is optionally fed into a refined stock chest (4), which is also known in the art as the blend chest. Alternatively, the pulp can be placed in a storage tank prior to being fed into the blend chest. The blend chest mixes or blends different fibers or stocks. The fibers that are blended can vary and depend upon the paper product that is being produced. The stock consistency in the blend chest is typically from 4 to 6%.

After the stock has been refined, it is transported to the machine chest (5). The machine chest is the last holding tank before the stock is sent to the paper making machine. In the machine chest, the stock typically has a consistency of from 3 to 5%.

From the machine chest, the stock is transported to the elevated headbox or stuff box (6). The stuff box is a consistency regulator, which ensures that the consistency of the stock is constant when it is sent to the headbox. The excess stock from the stuff box is recycled and sent back to the machine chest via transport line (7). The stock consistency at the stuff box is generally from 2.5 to 3.5%.

Once the stock has passed through the stuff box, it is diluted to be from 0.5 to 1.8% consistency in order to avoid clump formation, which results in the formation of lumpy paper. Fan pumps (8) are used to pump large volumes of water that are used to dilute the stock. Following dilution, the stock is sent through a series of cleaners (9) and screens (10) and (11) to remove foreign materials. Once the diluted, or thin stock, has passed the screens and cleaners, it is fed to the headbox where it is converted to a paper product. The headbox, which is not shown in FIG. 3, is a reservoir that controls the flow of thin stock to the paper forming section of the paper machine.

Once the pulp has been contacted with the anionic colloidal silica, the resultant pulp can be further processed using techniques known in the art to produce a variety of paper products that exhibit anti-skid properties. In one embodiment, the pulp that is contacted with the anionic colloidal silica can be converted to newspapers and light weight printing papers. The applicants have discovered that lower amounts of anionic colloidal silica are required to enhance anti-skid properties of the cellulosic fiber when the anionic colloidal silica is added at or before the stuff box.

As described above, the consistency of the suspension at the stuff box is typically higher when compared to the consistency of the suspension at any point beyond the stuff box in the paper making machine. In one embodiment in this invention, prior to or at the point of contacting the suspension with colloidal anionic silica, the consistency of the suspension at least than 2.5%, preferably from 2.5 to 12%. In other various embodiments, the consistency is from 3 to 12%, 3.5 to 12%, 4 to 12%, 4.5 to 12%, 5 to 12%, 6 to 10%, and 6 to 8%.

Not wishing to be bound by theory, by using a higher consistency of the suspension (i.e. a thick stock), more of the anionic colloidal silica will be in contact, and, thus, incorporated into the cellulosic fiber. Therefore, a lower amount of anionic colloidal silica is required in the present invention when compared to prior art methods to impart anti-skid properties on a cellulosic fiber. Moreover, the present invention avoids the need for a surface treatment of silica, which is not possible or practical for certain applications, such as newspaper production, where the line speed is fast.

Any anionic colloidal silica known in the art is useful in the present invention. Examples of silica compounds useful in the present invention are those disclosed in but not limited to *The Chemistry of Silica* by Ralph K. Iler (John Wiley & Sons, 1979). The size and shape of the anionic colloidal silica can vary depending upon the type of silica used. In one embodiment, the anionic colloidal silica has a particle size of from 10 to 120 nm, preferably from 20 to 90 nm. As described above, the amount of anionic colloidal silica used in the present invention is less than prior art methods. In one embodiment, the amount of colloidal anionic silica is from 0.0125 to 0.75%, preferably from 0.02 to 0.35% by weight of the cellulosic fiber.

The colloidal anionic silica can be injected directly into the suspension or fed by an inlet into a container holding the suspension. Once the anionic colloidal silica has been added to the suspension, process conditions (i.e. temperature and time) can be varied depending upon the consistency of the suspension, the amount of anionic colloidal silica that is added to the suspension, and the point at which the anionic colloidal silica is added to the suspension. In one embodiment, the suspension is contacted with anionic colloidal silica at from 15 to 75° C. In one embodiment, the suspension is contacted with the anionic colloidal silica at from one minute to three hours.

The anionic colloidal silica is not merely coated or sprayed onto the surface of the cellulosic fiber. The contacting step involves the incorporation of the anionic colloidal silica throughout the cellulosic fiber and not just on the surface. In one embodiment, the contacting step comprises mixing the suspension with the anionic colloidal silica so that the anionic colloidal silica is dispersed throughout the suspension.

Aluminum compounds can also be added in order to acidify the suspension prior to contacting the suspension with the anionic colloidal silica. In one embodiment, prior to the contacting step, the pH of the suspension is from 3 to 7, preferably from 3.5 to 5.5. The aluminum compound can be used to lower the pH of the suspension. In another embodiment, aluminum compounds can be added to adjust the soluble charge in solution. In another embodiment, aluminum compounds can be used in combination with sizing agents.

In one embodiment, the source of the aluminum compound can be residual aluminum compounds from the paper making process. In another embodiment, the residual aluminum compounds can come from pulp generated from recycled paper.

In another embodiment, an additional aluminum compound can be added directly to the suspension prior to the stuff box. Examples of residual and additional aluminum compounds useful in the present invention include, but are not limited to, aluminum polychloride, a basic polychloride of aluminum, a basic polysulfate of aluminum, a basic polychlorosulfate of aluminum, an aluminate, aluminum chloride, alum, aluminum nitrate, or polyaluminum silicate-sulfate. The amount of the aluminum compound that contacts the suspension can vary depending upon the paper-making machine used and is known to one of skill in the art. In one embodiment, the amount of the residual and additional aluminum compound that is contacted with the suspension is greater than 0.01% based on the weight of the cellulosic fiber.

The suspension can be contacted with other components prior to or after contacting the suspension with the anionic colloidal silica, including other components known in the art for cellulosic fiber processes. In one embodiment, the additional component is a sizing agent, such as alkyl ketene dimers, fluorinated phosphates, carboxylic acid anhydrides, styrene/maleic anhydride copolymers, and derivatives thereof. In one embodiment, the suspension can be contacted with a biocide of from 0.01 to 0.5% by weight based on the cellulosic fiber. Examples of other additives that can be added include, but are not limited to, dyes, filler pigments, retention aids, and wet and dry strength additives. The amount of the additive that is added and the point of addition of the additive in the paper making process is known in the art.

In another embodiment, when the cellulosic fiber produced by the present invention is used to produce newspapers, the suspension is not contacted with a sizing agent or a cationic starch. Examples of such sizing agents excluded include alkyl ketene dimers, fluorinated phosphates, carboxylic acid anhydrides, styrene/maleic anhydride copolymers, and derivatives thereof.

One object of the present invention is to enhance the anti-skid or friction properties of a cellulosic fiber. The property of a cellulosic fiber that predicts the tendency of the cellulosic fiber to slide or slip when in contact with another cellulosic fiber or other medium is friction. The friction of a paper substrate is defined by a quantitative value, the coefficient of friction. The static coefficient of friction measures the force or energy required to start an object in motion and the kinetic coefficient of friction relates to the force required to keep the body in motion once it has started moving.

One method for quantifying the static and kinetic coefficients of friction is by the horizontal plane method. In this method, a sheet of paper (top sheet) is placed on top of a second sheet of paper (bottom sheet). A sled or weight of known mass is affixed to the top sheet and the bottom sheet, wherein the bottom sheet is affixed to the horizontal plane. The sled is then pulled at a constant speed. The force required to begin movement of the sled (static) is recorded and the force required to maintain the sled in motion (kinetic or dynamic) is also recorded. A force gauge or load cell is applicable to measure this value (Tappi Test Methods, T549 pm-90).

In general, the static coefficient of friction is 10 to 20% higher than the kinetic coefficient of friction. In one embodiment, the cellulosic fiber has a static and kinetic coefficient of friction of from 0.25 to 0.60 after the cellulosic fiber has been contacted with the anionic colloidal silica in the process of this invention. In another embodiment, the cellulosic fiber produced by the present invention has a static and kinetic coefficient greater than or equal to 0.3.

The present invention is directed to a method for enhancing the anti-skid or friction properties of a cellulosic fiber. The applicants have discovered that the addition of the anionic colloidal silica to the cellulosic fiber at or before the stuff box does not enhance or increase the retention properties of the cellulosic fiber. The prior art teaches that addition of colloidal silica at the headbox enhances the retention properties of the fiber. Thus, the cellulosic fiber produced by this invention is clearly different from that produced by prior art processes.

EXAMPLES

The following examples are put forth so as to provide those of ordinary skill in the art with a complete disclosure and description of how the methods and products claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at room temperature and pressure is at or near atmospheric.

Static and kinetic coefficients of friction were quantified by the horizontal plane method as described above.

Example 1

The present invention was used in a commercial paper machine to produce a newsprint grade of paper. The amount of anionic colloidal silica sol was varied. The anionic colloidal silica had a particle size of 80 nm. Anionic colloidal silica, sodium aluminate (25 lbs/ton of dry fiber), and alum (20 lbs/ton of dry fiber) were added to 100% groundwood in the machine chest. The amount of soluble alumina present was 0.33 ppm. Table 1 reveals the significant impact on static and kinetic coefficients of friction.

TABLE 1

| Amount of Anionic Colloidal Silica (%) | Static Coefficient of Friction | Kinetic Coefficient of Friction |
|---|---|---|
| 0 | 0.434 | 0.279 |
| 0.05 | 0.467 | 0.311 |
| 0.125 | 0.496 | 0.329 |
| 0.175 | 0.5 | 0.35 |

When the anionic colloidal silica sol was used on a continuous basis, additional benefits were apparent in the printing operation. Newsprint press performance was documented for over a 6 month period. FIG. 1 demonstrates the reduction in breaks per 100 rolls that occurred in the particular press room when the anionic colloidal silica sol was employed in the paper manufacturing process.

Figure 2:
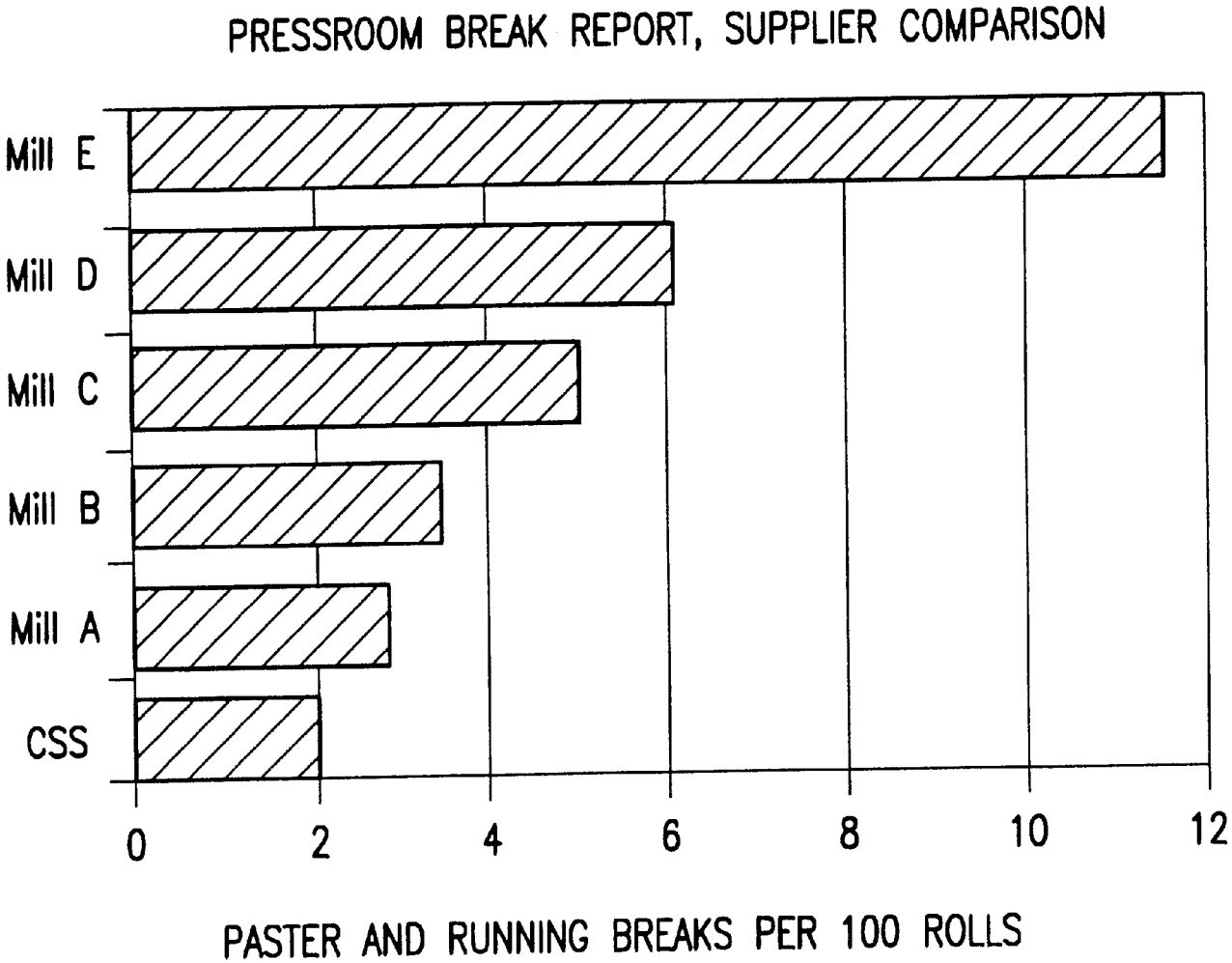
FIG. 2 compares newsprint produced from pulp that was contacted with anionic colloidal silica sol compared to other suppliers newsprint paper that do not use anionic colloidal silica in the production of newsprint.

FIG. 2 compares newsprint producer utilizing colloidal silica sol technology of the present invention to other suppliers' newsprint paper that do not use the present invention. FIG. 2 reveals that the present invention (labeled CSS) produces paper that has fewer paster and running breaks.

The results in Table 1 and FIGS. 1 and 2 clearly depict the enhancement in kinetic and static coefficient of friction as well as to positive impact on improvements of press room operation.

Example 2

The present invention was evaluated against the use of calcined kaolin in a 28# newsprint sheet. Sodium aluminate (18 lbs/ton of dry fiber) and alum (13 lbs/ton of dry fiber) were added to a composition of pulp composed of 20% softwood kraft, 14% groundwood, 33% thermomechanical pulp, and 33% deinked pulp in the machine chest. The amount of soluble alumina present was 0.4 ppm. Colloidal silica sol was added to the discharge of the machine chest in amounts specified in Table 2. The pH at the headbox was 4.4. The amount of calcined kaolin that was added was 1% and the amount of anionic colloidal silica sol (CSS) that was added was 0.075%. Table 2 reveals the kinetic coefficient of friction data.

TABLE 2

| Component | Amount of Component (%) | Kinetic Coefficient of Friction |
|---|---|---|
| Calcined Clay | 1 | 0.315 |
| Calcined Clay | 1 | 0.300 |
| CSS | 0.075 | 0.300 |
| CSS | 0.075 | 0.310 |

A direct comparison of the present invention when compared to the addition of calcined clay resulted in equal performance with respect to the kinetic coefficient of friction of the newsprint sheet.

When using an embodiment of the present invention (i.e. the addition of colloidal silica sol), the process additives utilized to maintain operation of the paper machine (i.e. polymers) while feeding significant amounts of calcined kaolin, were reduced by 30 to 40% during the evaluation. Moreover, a reduction in costs was realized by substituting anionic colloidal silica for calcined kaolin in order to improve sheet friction. Additional savings from the reduction of process additives are also available.

Example 3

The first pass retention was measured for the cellulosic fiber prepared in Example 2, wherein from 0.05 to 0.125% CSS was added to the pulp at the machine chest discharge. Methods for measuring the first pass retention are known in the art. Table 3 reveals that the present invention does not enhance or increase the retention properties of the cellulosic fiber when the colloidal silica sol is added after the machine chest and prior to the stuff box.

TABLE 3

| Time (hours) | CSS Addition Rate | First Pass Retention |
|---|---|---|
| 0 | 0 | 52.5 |
| 2.0 | 0.05% | 52.7 |
| 3.0 | 0.125% | 52.8 |

Throughout this application, various publications are referenced. The disclosures of these publications in their entireties are hereby incorporated by reference into this application in order to more fully describe the state of the art to which this invention pertains.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for enhancing the anti-skid or friction properties of a cellulosic fiber, comprising:

a) transporting cellulosic fiber from a machine chest and then to a stuff box and then to a headbox; and b) contacting a suspension of the cellulosic fiber with an anionic colloidal silica prior to or at the stuff box, wherein the suspension has a consistency of greater than or equal to 2.5%.

2. The method of claim 1, further comprising in the transporting step, the cellulosic fiber is transported to a blend chest prior to the machine chest.

3. The method of claim 2, wherein in the contacting step, the suspension is contacted with the anionic colloidal silica from between the blend chest and the machine chest.

4. The method of claim 2, wherein in the contacting step, the suspension is contacted with the anionic colloidal silica in the blend chest.

5. The method of claim 2, wherein in the contacting step, the suspension is contacted with the anionic colloidal silica prior to the blend chest.

6. The method of claim 1, wherein in the contacting step, the suspension is contacted with the anionic colloidal silica from between the machine chest and the stuff box.

7. The method of claim 1, wherein in the contacting step, the suspension is contacted with the anionic colloidal silica in the machine chest.

8. The method of claim 1, wherein the cellulosic fiber comprises pulp.

9. The method of claim 8, wherein the pulp comprises bleached pulp, mechanical pulp, chemical pulp, de-inked pulp, or recycled paper pulp.

10. The method of claim 1, wherein the cellulosic fiber is recycled newspaper or recycled liner board.

11. The method of claim 1, wherein the consistency of the suspension is from 2.5 to 12%.

12. The method of claim 1, wherein the anionic colloidal silica has a particle size of from 10 to 120 nm.

13. The method of claim 1, wherein the anionic colloidal silica has a particle size of from 20 to 90 nm.

14. The method of claim 1, wherein the suspension is contacted with the anionic colloidal silica at from 15 to 75° C.

15. The method of claim 1, wherein the amount of anionic colloidal silica is from 0.0125 to 0.75% by weight of the cellulosic fiber.

16. The method of claim 1, wherein the amount of anionic colloidal silica is from 0.02 to 0.35% by weight of the cellulosic fiber.

17. The method of claim 1, further comprising contacting the suspension with an aluminum compound.

18. The method of claim 17, wherein the suspension is contacted with the aluminum compound prior to the stuff box.

19. The method of claim 17, wherein the aluminum compound comprises aluminum polychloride, a basic polychloride of aluminum, a basic polysulfate of aluminum, a basic polychlorosulfate of aluminum, an aluminate, aluminum chloride, alum, aluminum nitrate, polyaluminum silicate, or a mixture thereof.

20. The method of claim 17, wherein the amount of aluminum compound is greater than 0.01% based on the weight of the cellulosic fiber.

21. The method of claim 1, wherein the contacting step comprises mixing the suspension with the anionic colloidal silica.

22. The method of claim 1, wherein after the contacting step, the cellulosic fiber has a static coefficient of friction of from 0.25 to 0.60.

23. The method of claim 1, wherein after the contacting step, the cellulosic fiber has a static coefficient of friction of greater than or equal to 0.3.

24. The method of claim 1, wherein after the contacting step, the cellulosic fiber has a kinetic coefficient of friction of from 0.25 to 0.60.

25. The method of claim 1, wherein after the contacting step, the cellulosic fiber has a kinetic coefficient of friction of greater than or equal to 0.3.

26. The method of claim 1, wherein prior to the contacting step, the pH of the suspension is from 3 to 7.

27. The method of claim 1, wherein prior to the contacting step, the pH of the suspension is from 3.5 to 5.5.

28. The method of claim 1, wherein the suspension is not contacted with a sizing agent.

29. The method of claim 1, wherein the suspension is not contacted with a cationic starch.

30. The method of claim 1, wherein the suspension has a consistency of from 3 to 5%.

31. The method of claim 1, wherein the suspension has a consistency of from 2.5 to 3.5.

32. A method for enhancing the anti-skid or friction properties of a cellulosic fiber, comprising:

a) transporting cellulosic fiber from a stuff box to a headbox; and b) contacting a suspension of the cellulosic fiber with an anionic colloidal silica prior to or at the stuff box, wherein the suspension has a consistency of greater than or equal to 2.5%.

33. The method of claim 32, wherein the suspension has a consistency of from 2.5 to 12.

34. The method of claim 32, wherein the suspension has a consistency of from 2.5 to 3.5.

35. The method of claim 32, wherein the suspension has a consistency of from 3 to 5%.

* * * * *